US008714172B2

(12) United States Patent
Heim

(10) Patent No.: US 8,714,172 B2
(45) Date of Patent: May 6, 2014

(54) POLE GRIP

(76) Inventor: Eberhard Heim, Unterensingen (DE)

( * ) Notice: Subject to any disclaimer, the term of this patent is extended or adjusted under 35 U.S.C. 154(b) by 0 days.

(21) Appl. No.: 13/635,802

(22) PCT Filed: Mar. 10, 2011

(86) PCT No.: PCT/EP2011/053596
§ 371 (c)(1),
(2), (4) Date: Oct. 19, 2012

(87) PCT Pub. No.: WO2011/113739
PCT Pub. Date: Sep. 22, 2011

(65) Prior Publication Data

US 2013/0048039 A1 Feb. 28, 2013

(30) Foreign Application Priority Data

Mar. 19, 2010 (CH) ..... 413/10

(51) Int. Cl.
*A45B 9/02* (2006.01)
*A63C 11/22* (2006.01)

(52) U.S. Cl.
CPC ..... *A45B 9/02* (2013.01); *A63C 11/222* (2013.01); *A45B 2009/025* (2013.01)
USPC ..... 135/72; 135/65; 280/821; 16/421

(58) Field of Classification Search
CPC .... A63C 11/222; A45B 9/02; A45B 209/025; B25G 1/00
USPC ..... 135/65–66, 72, 76; 280/819–823; 16/421, 431, 436
See application file for complete search history.

(56) References Cited

U.S. PATENT DOCUMENTS 3,113,786 A * 12/1963 Phillipson ..... 280/822
3,560,014 A * 2/1971 Bruckl et al. ..... 280/821
4,288,100 A * 9/1981 Aho ..... 280/821
4,288,101 A * 9/1981 Aho ..... 280/821
4,416,036 A 11/1983 Aho (Continued)

FOREIGN PATENT DOCUMENTS

DE 75 10 832 U 7/1975
DE 28 29 855 A1 1/1980

(Continued)

*Primary Examiner* — Winnie Yip
(74) *Attorney, Agent, or Firm* — Sughrue Mion, PLLC

(57) ABSTRACT

A pole grip for a skiing pole, trekking pole or walking pole, with a fastening mechanism allowing a hand loop to be fixed with variable length. The hang grip is characterized in that the fastening mechanism comprises a triggering element pivotably mounted in a recess in the head region of the grip about a pivot axis that is transverse to the pole axis, the recess is a through-opening aligned at an acute angle to the pole axis, the hand loop is inserted into the recess through a lower opening of the recess, the hand loop has a first end portion being fastened to the triggering element, and a second end portion, in a securely clamped state, is guided between an inner wall and a retaining region of the triggering element, and is guided through an upper opening of the recess, and is clamped in a positive and/or a non-positive locking manner, the clamping is released by a tilting of the triggering element, and the second end portion can be moved upward and downward to adjust the length of the hand loop.

21 Claims, 2 Drawing Sheets

(56) References Cited

U.S. PATENT DOCUMENTS

| | | | | |
|---|---|---|---|---|
| 5,328,205 | A * | 7/1994 | Bacharach | 280/822 |
| 6,139,060 | A * | 10/2000 | Lenhart | 280/821 |
| 6,325,418 | B1 | 12/2001 | Lenhart | |
| 6,386,588 | B1 * | 5/2002 | Young et al. | 280/821 |
| 6,439,610 | B1 * | 8/2002 | Pronzati | 280/822 |
| 6,851,437 | B1 * | 2/2005 | Lenhart | 135/72 |
| 7,226,084 | B2 * | 6/2007 | Lenhart | 280/822 |
| 7,621,564 | B2 * | 11/2009 | Lenhart | 280/821 |
| 7,661,713 | B2 * | 2/2010 | Panizza | 280/821 |
| 7,891,708 | B2 * | 2/2011 | Panizza | 280/822 |

FOREIGN PATENT DOCUMENTS

| | | | |
|---|---|---|---|
| DE | 32 05 184 | A1 | 9/1982 |
| DE | 20 2004 017 843 | U1 | 3/2005 |
| EP | 1 036 579 | A2 | 9/2000 |
| WO | 2009/022047 | A1 | 2/2009 |

* cited by examiner

POLE GRIP

CROSS REFERENCE TO RELATED APPLICATIONS

This application is a National Stage of International Application No. PCT/EP2011/053596 filed Mar. 10, 2011, claiming priority based on Switzerland Patent Application No. 00413/10 filed Mar. 19, 2010, the contents of all of which are incorporated herein by reference in their entirety.

TECHNICAL FIELD

The present invention relates to a pole grip, in particular for a cross-country skiing pole, trekking pole, skiing pole or Nordic walking pole, with a fastening mechanism for a hand loop, which allows the hand loop to be fixed with variable length, wherein the fastening mechanism is arranged in a recess in the head region of the pole grip.

PRIOR ART

Pole grips are traditionally fastened to the hand of the user by fastening a hand loop in the head region of the pole grip, the user grips into this hand loop and then grasps the pole grip through this hand loop. For different hand sizes and also for different usage situations, it is an advantage with these hand loops if their length can be variably adjusted without needing to pick up a tool for this purpose. Accordingly, there is already a plurality of technical possibilities for implementation for variably configuring the fastening of a hand loop on a pole grip.

Such fastening mechanisms should be configured to be as simple as possible in order to be inexpensive to produce and also not liable to malfunctioning in use, and they should at the same time ensure that in particular a lengthening of the loop is only possible when the corresponding fastening mechanism is actively released for adjustment.

DESCRIPTION OF THE INVENTION

Accordingly it is the object of the present invention to provide an improved pole grip, in particular for a cross-country skiing pole, trekking pole, skiing pole or Nordic walking pole, with a fastening mechanism for a hand loop, which allows the hand loop to be fixed with variable length. The fastening mechanism is arranged in a recess in the head region of the pole grip. The pole grip proposed according to the invention is characterized in particular in that the fastening mechanism comprises a triggering element (or retaining element) pivotably or tiltably mounted about a pivot axis, arranged transversely in relation to a pole axis, and arranged in the recess. The recess is designed as a through-opening which is aligned at an acute angle to the pole axis, the lower opening of which opens outwards within or above a rear grip region, facing the palm of the hand, and the upper opening of which opens upwards towards the upper side of the pole grip. The hand loop is fastened by a first end portion to the triggering element, passes through the lower opening outwards towards the hand (and runs around this normally), and the hand loop is inserted with a second end portion through the lower opening into the recess. In the securely clamped state, the second end portion is then guided in this recess between an inner wall of the recess (or an additional element arranged therein) and a retaining region of the triggering element, arranged above the pivot axis, and is clamped in a non-positively and/or positively locking manner therebetween. The second portion of the loop is then guided through the upper opening out of the pole grip. The clamping can be released by a tilting of the triggering element about the pivot axis and the second end portion can be moved downwards in the pole grip and lengthened to a certain extent when (and only when) the triggering element is tilted.

According to a particularly preferred embodiment, the second end portion guided from the upper opening from the pole grip is guided back to the pole grip again to form a loop and is fixed with its guided-back free end on the pole grip. This loop enables the loop length to be shortened, for example, by gripping in with a finger, by pulling on this loop. Since the loop is clamped with the region of the triggering element above the pivot axis, in general with a suitable configuration of the retaining region the loop can be shortened by pulling upwards without the triggering element needing to be manipulated or tilted. In other words, the triggering element is only actuated when the loop is to be pulled downwards, that is to be lengthened.

A further preferred embodiment in this connection is characterised in that the recess in the wall section of the inner wall facing the retaining region comprises a receiving recess, which is preferably configured as a T-shaped recess with an open region (which preferably extends substantially along the pole axis or at an acute angle to this, is closed at the bottom and open at the top) facing the triggering element and two lateral extensions. The free end of the loop is fastened in this receiving recess. The fastening can be accomplished, for example, by means of a screw, by gluing, injection moulding, clamping or generally a fastening element or similar.

It is particularly preferred however that the fastening of this free end is accomplished by arranging a fixing element (for example, a block of plastic with a shape adapted to the recess) in the receiving recess, where the front side thereof (the side facing the recess, which fills the open region of the T-shaped recess) forms the counterpressure surface against which the retaining region preferably directly clamps the second end portion and wherein the free end of the loop is clamped between the rear side thereof opposite the front side and a wall section of the receiving recess. On the rear side of the fixing element, a toothed structure, mandrels, a special surface treatment or structuring, e.g. anti-slip or a corresponding coating, can be provided for the purposes of fastening the free end. This fixing element is preferably inserted from above into the T-shaped recess and preferably the free end is substantially only fastened non-positively and/or positively on the pole grip by clamping between fixing element and receiving recess. Alternatively or additionally however, it is also possible to provide an adhesive connection. It is also possible to fasten the free end, for example, with a screw or by means of gluing on the fixing element and then insert this into the receiving recess.

A further preferred embodiment is characterised in that the triggering element is accessible at least partially via the upper opening (for example, since one can grip at least partially into this upper opening) or projects from this and that a pressure surface for the manipulation for tilting is formed in this accessible region or the region projecting via this upper opening.

A further preferred embodiment is characterised in that the second end portion is inserted through the lower opening into the recess and is clamped in the firmly clamped state between the rear inner wall and the retaining region of the triggering element arranged above the pivot axis, and that the first end portion is fixed below this clamping region on the triggering element, preferably using a fastening screw.

It is further preferred that the retaining region of the triggering element has a toothed structure, where this toothed structure is particularly preferably configured as a sawtooth structure so that in the clamped state, withdrawal of the second section downwards from the lower opening is prevented (lengthening of the loop), a displacement upwards from the upper opening (shortening of the loop), in particular by manipulation of an upper overhang (upper return, loop) of the second section is possible without manipulation of the triggering element.

Normally the triggering element is braced against the inner wall via the retaining region by means of an elastic restoring element, in particular a spring, preferably a leaf spring or spiral spring, but an elastomer spring is also possible or a resilient injection-moulded part of the triggering element or of the corresponding wall region of the recess.

Further preferably, the head region has a forwardly directed, downwardly inclined bevel, where the upper opening is arranged in this bevel and where preferably the triggering element is accessible at least partially via the upper opening in the area of this bevel or projects beyond this and where further preferably in this accessible region or the region projecting beyond this upper opening, is formed as a pressure surface for the manipulation for tilting.

In addition, the triggering element can preferably have a forwardly and downwardly directed extension in relation to the direction of use of the pole grip, which covers the gap between triggering element and the wall delimiting the upper opening of the recess at least partially, preferably substantially completely in order to prevent the penetration of dirt and/or snow and/or ice. Alternatively it is possible to configure this region in the sense of a labyrinth seal, for example whereby the wall has a web in this region and the triggering element has a corresponding groove in which the web engages and in which the web penetrates further when the triggering element is tilted. Naturally, the web can also be arranged on the triggering element and the groove on the wall region. Another alternative consists in providing a flexible sealing lip on the triggering element and/or on the wall in this region, where this is preferably moulded on directly in a two-component injection moulding process.

Typically the pole grip has a recess on the underside for receiving a pole tube.

The hand loop can comprise a simple loop (loop band, typically made of woven textile, in particular of dimensionally stable plastic fabric, typically having a thickness in the range of 0.3-2 mm, and/or normally having a width in the range of 3-20 mm, preferably having a width in the range of 4-10 mm, where this width applies to that region which can come to lie in the fastening region, the regions lying in the hand can also be broader and in particular, for example, can comprise a soft sewn-on region, for example, made of neoprene). Alternatively said hand loop can comprise a loop which can be fastened to the hand with three separate openings for thumb, finger/back of hand and wrist. Typically such loops are configured to be adjustable with a hook and loop fastener around an eye. Or it can comprise a glove with loop strips fastened thereto.

Typically such a pole grip has a sleeve made of hard plastic, which has soft coatings in the grip region, such elements can be produced in a two-component injection moulding method. The triggering element is preferably also made of hard plastic, where the aforesaid toothed structure can be made of the same material (in one piece) for example but can also be formed by metal inserts or similar. The pivot axis for the triggering element is typically made of metal or plastic or a combination thereof and can be inserted laterally into the recess through two corresponding opposite openings in the material of the sleeve after inserting the triggering element, where the openings in the sleeve and an axial opening in the triggering element are passed through.

The invention further relates to a cross-country skiing pole, trekking pole, skiing pole or Nordic walking pole, with a pole grip according to one of the preceding claims.

Further embodiments are given in the dependent claims.

BRIEF DESCRIPTION OF THE DRAWINGS

Preferred embodiments of the invention are described in detail hereinafter with reference to the drawings which serve merely for explanation and are not to be interpreted as restrictive. In the drawings.

DESCRIPTION OF PREFERRED EMBODIMENTS

Figure 1:
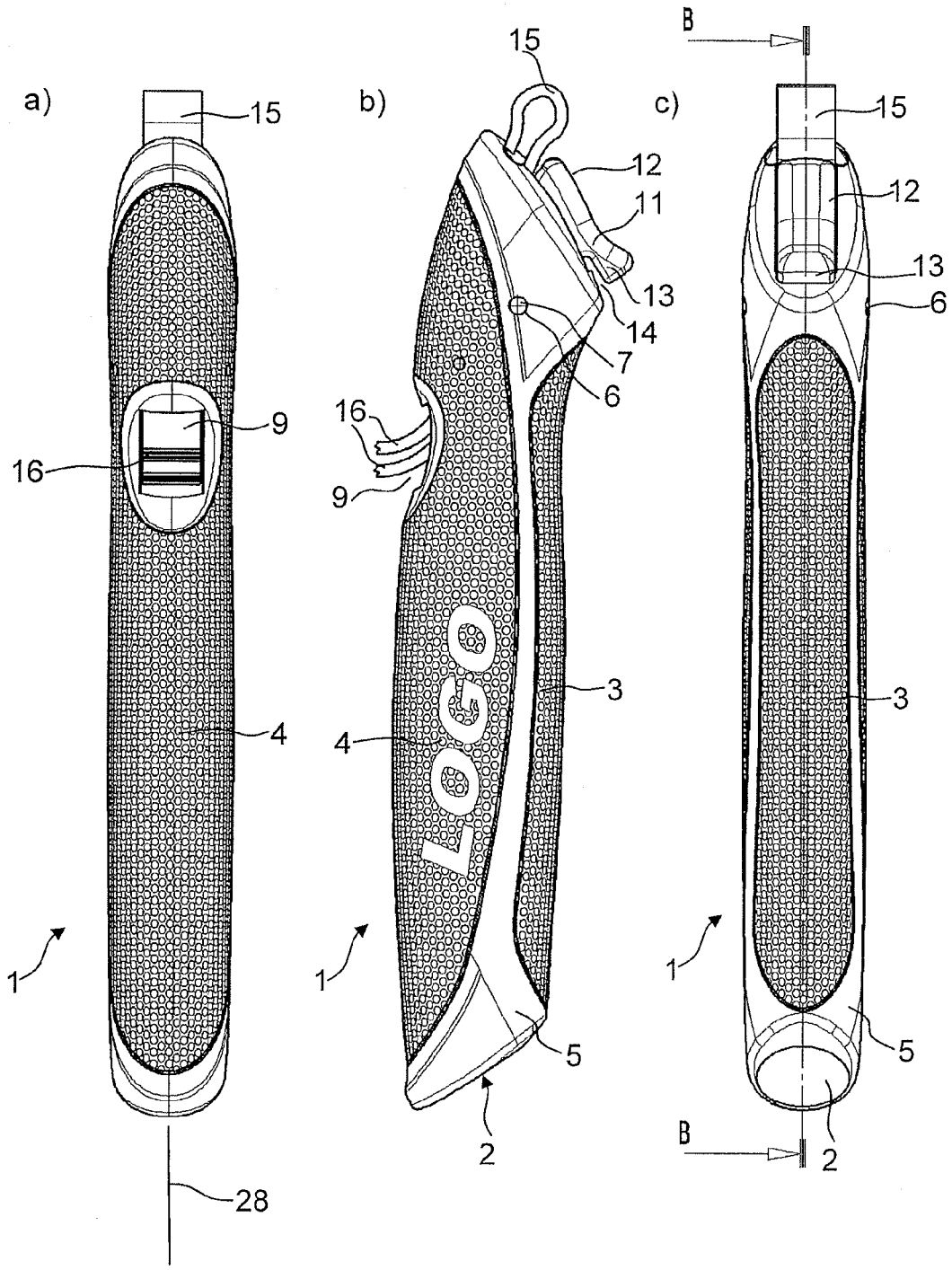
FIG. 1 shows a pole grip with a fastening mechanism according to the invention, where a) shows a view from behind (in relation to the direction of movement), b) shows a view from the side and c) shows a view from the front in the direction of movement, d) shows a perspective view obliquely from the front, e) shows an axial section along the line B-B as shown in FIG. 1*c*) when the fastening mechanism is closed and in f) in the position of the open fastening mechanism, i.e., with tilted triggering element and g) shows a view of such a pole grip from above.
Figure 1:
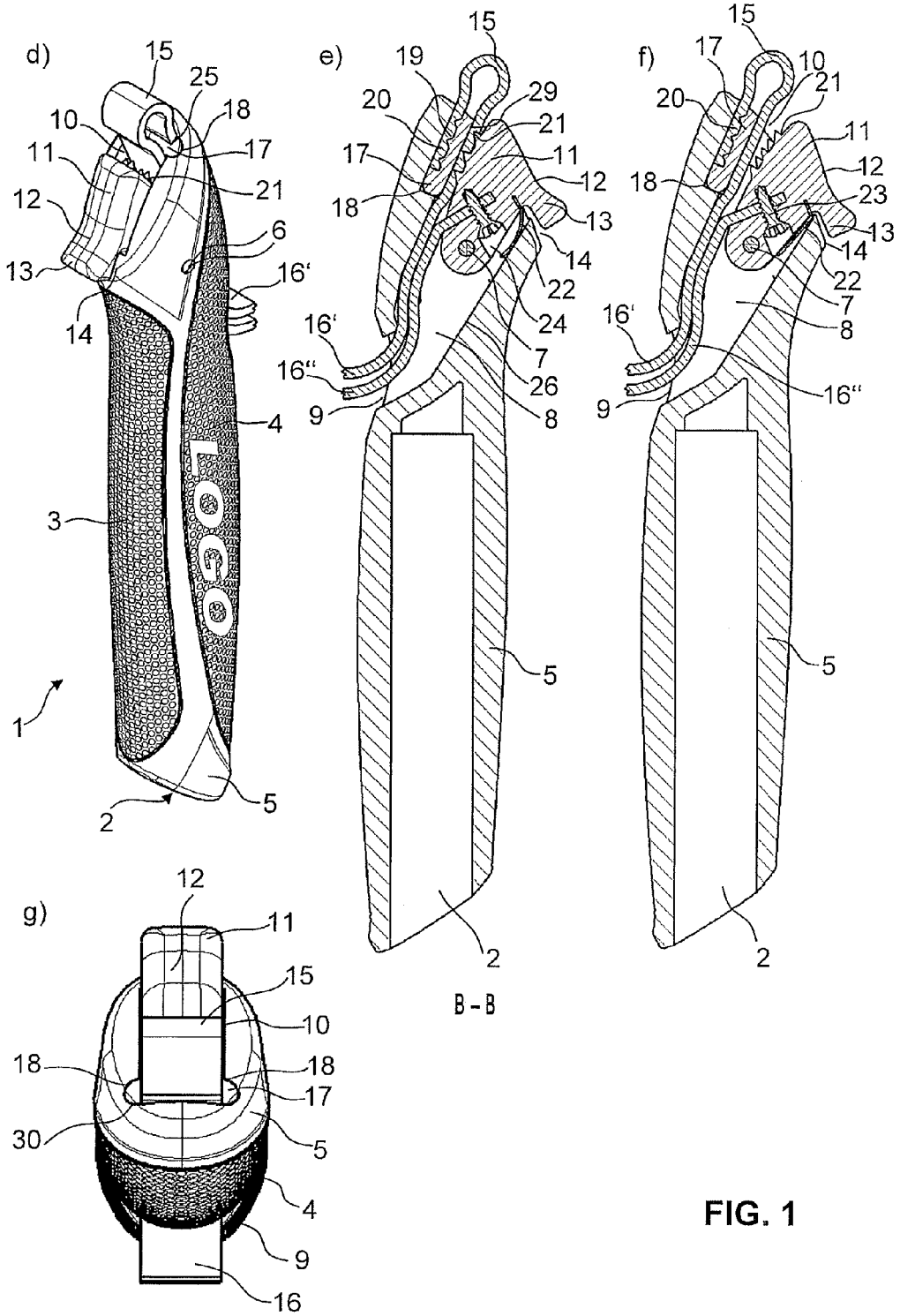

FIG. 1 shows in different views a pole grip with a fastening mechanism according to the invention. The pole grip 1 has a plastic sleeve 5 made of hard plastic which has a recess 2 for a pole tube (not shown) at its lower end. The pole tube is typically pressed in and/or glued into this recess. This sleeve 5 extends along a tube axis 28 or tube grip axis and in the lower region such a tube grip has an actual grip region which, in this exemplary embodiment, has a soft/grip-friendly coating 3 and/or a surface structuring in the region directed towards the front in the direction of motion and also has a soft or surface-structured grip region 4 in the rear region facing the palm of the hand. These soft grip regions can either consist of leather but they can also be made of a soft plastic material with a rough surface, parts of this type made of two different types of plastics can, for example, be produced in a two-component injection moulding process. It is also possible to use a foam sleeve or foam surface regions (pads) which are glued onto the surface in regions 3 and/or 4. Cork or leather can be used similarly.

A recess 8 is arranged in the head region of the tube grip. This recess 8 extends at an acute angle relative to the tube axis 28, since it extends from a lower opening 9 arranged approximately at two-thirds of the total height, as shown in FIG. 1*e*, obliquely upwards to an upper opening 10. The recess 8 is therefore configured as a through opening. The loop strip emerges from the tube grip from the lower opening 9 and normally runs around the hand as a closed strip.

A triggering element 11 is arranged in this elongated recess 8 arranged at an acute angle to the tube axis, in the form of a through opening. This triggering element 11 has an axial bore arranged transversely to the tube axis through which a pivot axis 7 passes, which is mounted in two axial holes 6 arranged laterally opposite in the sleeve. The triggering element 11 is accordingly rotatably or pivotably mounted by means of this axis 7 over a small angular range, typically no more than 10-15 degrees.

The triggering element 11 is arranged with a lower part in the recess 8, but projects with an upper part from this recess 8 and from the upper opening 10 and a pressure surface 12 is formed on the upper surface. The triggering element 11 is tilted by manipulation of this pressure surface 12, for example by hand.

On its side facing the rear side (in the direction of movement) the triggering element 11 has a region that is configured with a toothed structure 21 and which there comes in direct contact with one of the two loop ends. On the opposite side, the triggering element 11 is braced by means of a leaf spring 22 against the opposite front wall region 26 of the recess 8. This spring has the result that the triggering element 11 is pressed in the anticlockwise direction in FIGS. 1*e*) and *f*) and accordingly is elastically braced against the opposite rear inner wall 27 of the recess.

In the region of the rear wall 27 of the recess 8 opposite the toothed structure 21, a T-shaped recess 18 is formed in the material of the sleeve 5. This recess 18 has an elongated open section which is open towards the recess 8 and extends approximately in the direction of the tube axis or at an acute angle thereto and expands towards the rear laterally in two extensions 30. The receiving recess 18 is open towards the top but closed towards the bottom. A fixing element 17 having corresponding shaping is inserted from above into this receiving recess 18. Corresponding shaping means that in particular the lateral configuration is adapted to the two lateral extensions 30 and a substantially positive adjoining to these regions is achieved. The front side 29 of the fixing element 17 is accordingly directly facing the triggering element 11 and one of the loop regions is guided through between the front side 29 and the toothed structure 21 of the triggering element 11.

Specifically, the loop guidance is as follows: a first end of the loop, the portion 16" of the loop strip fastened on the triggering element, is inserted in a recess in the form of a slot provided accordingly for this purpose on the triggering element 11 and is fixed there with a fastening screw 23 which is located above the pivot axis 7 and can be screwed in through a recess 24 in the triggering element 11 and passes through the loop strip in a fastening manner. From this fastening, this loop portion 16" emerges towards the bottom through the recess and then through the lower opening 9, and runs around the hand before again entering into the tube grip as the portion of the loop strip 16' fastened on the fixing element. In addition, the loop need not be guided as a continuous loop around the hand, but can also comprise separate loop portions. The hand-holding device can therefore be a continuous loop but can also comprise a loop with separate through openings for thumb, finger/back of hand and wrist, or even a glove with two corresponding loop portions.

The loop portion 16' therefore passes through the lower opening 9 into the recess 8 and comes to lie above the portion 16" and between the portion 16" and the rear inner wall 27 of the recess 8. The portion 16' is now guided further upwards between the triggering element and the fixing element 7 or the front side 29 thereof, emerges at the top through the upper opening 10, there forms a returned loop 15 and enters into the tube grip again to a certain extent on the rear side of the fixing element 17. For this purpose, a U-shaped groove 25 is provided in the fixing element 17 adapted to the loop dimensions and on the rear side of the fixing element 17 a toothed structure 19 is provided which can bite firmly into the loop material. Accordingly, the fastening of this free end 20 of the loop portion 16' in the upper region of the tube grip can be achieved very simply, i.e., the free end 20 can simply be placed on the toothed structure 19 of the fixing element 17 and then the fixing element 17 can be inserted from above into the receiving recess 18. Either the associated positive or non-positive connection is sufficient or additional seamless bonding for example by using an adhesive, can be used to fasten the loop and the fixing element there.

The axis 7 is arranged in the triggering element 11 in the lowest part thereof and the axial region of the triggering element 11 forms the lowest portion of the triggering element. The clamping region in which the loop portion 16' is clamped between fixing element 17 and toothed structure 21, lies above the axis 7. This is important because as a result when there is a pull on the loop 15, the triggering element 11 is automatically turned in the anticlockwise direction as a result of the lever relationships in a diagram according to FIG. 1*e*) or *f*) and accordingly the clamping of the loop portion 16' is even further intensified with a downward pull on the loop. Accordingly, it is also important, and frequently of great advantage, that the fastening of the other end 16" of the loop is provided on the same side (in relation to the axis of rotation 7) of the triggering element 11 on this or in this triggering element 11 as the clamping of the portion 16' takes place. Thus, specifically when there is a pull on the loop portion 16", the triggering element 11 is also tilted in a direction of rotation so that the loop portion 16' experiences an even greater clamping force.

An advantage of this clamping is therefore the, to a certain extent, automatic secure clamping under increased tension. However, it is additionally of advantage that as a result of the selected lever relationships it is possible, for example by a pull on the loop portion 15, to shorten the loop, i.e., to pull the portion 16' further upwards through the recess 8 without needing to actuate the triggering lever 11. In order to assist this, the toothed structure 21 can be configured as a sawtooth structure which bites firmly when the loop is pulled downwards, but which offers no resistance when the loop 15 is pulled upwards.

If such a setting of the loop should now be changed, the triggering element 11 is tilted to the right into a position as shown in FIG. 1*f*) by gently applying pressure to the surface 12 in FIG. 1*e*) or *f*). Now the gap between the toothed structure 21 and the front side of the fixing element 17 is widened and the loop released in the clamping region so that the loop portion 16' can be pulled upwards, but in particular downwards, to expand the loop size and to adjust the same. This tilting of the triggering element 11 takes place against the restoring force of the leaf spring 22, i.e. when the lever 11 is released again, it springs back again in the anticlockwise direction so that the loop strip 16' is again clamped and fixed by the spring force of the spring 22.

A possible problem with such a mechanism is the fact that in the clamped state the region between the front inner wall 26 and the triggering element 11 must have a certain gap size specifically to enable the tilting. Dirt or ice or snow can pass through this gap into the interior of the recess and permanently block or even damage the mechanism. In order to avoid this problem, the triggering element 11 has a lower projection 13 on its front side, which in the clamped state, as shown in FIG. 1*e*) reaches over this gap so that only a very narrow constant gap 14 remains. Thus, to a certain extent a labyrinth seal is provided and if the gap 14 is selected substantially tangentially to the direction of rotation about the axis 7, the gap size can be selected to be very small without the mobility of the triggering element 11 being impaired by this. Such sealing measures can also be implemented differently, for example by flexible sealing lips or by groove/comb solutions, these are additionally not only possible in the lower region but also laterally in the gap between the triggering element 11 and the side walls of the recess 8.

REFERENCE LIST

1 Tube grip
2 Recess for tube pole
3 Front grip region
4 Rear grip region
5 Plastic sleeve made of hard plastic
8 Axial hole
7 Axis of rotation
8 Recess in tube grip region
9 Lower opening of 8
10 Upper opening of 8
11 Triggering element
12 Pressure surface of 11
13 Lower projection of 11
14 Gap between 13 and 5
15 Loop strip, upper overhang, return loop
16 Loop strip, lower emerging regions
16' Portion of loop strip fastened on fixing element
16" Portion of loop strip fastened on fixing element
17 Fixing element
18 Receiving recess, T-shaped recess for 17 in 5
19 Toothed structure on 17
20 Free end of 15
21 Toothed structure on 11
22 Restoring spring
23 Fastening screw
24 Recess in 11 for 23
25 U-shaped groove in 17 for 20
26 Front inner wall of 8
27 Rear inner wall of 8
28 Pole axis
29 Front side of 17
30 Lateral extensions of 18

The invention claimed is:

1. A pole grip with a hand loop attached thereto, the pole grip comprising:

a fastening mechanism for the hand loop, which allows the hand loop to be fixed with variable length, wherein the fastening mechanism is arranged in a recess in a head region of the pole grip, wherein the fastening mechanism comprises a triggering element pivotably mounted about a pivot axis, arranged transversely in relation to a pole axis or pole grip axis, and arranged in the recess, wherein the recess is designed as a through-opening which is aligned at an acute angle to the pole axis and the lower opening of which opens outwards within or above a rear grip region facing the palm of the hand, and the upper opening of which opens upwards towards the upper side of the pole grip, wherein the hand loop is fastened by a first end portion to the triggering element, passes through the lower opening outwards towards the hand, and the hand loop is inserted with a second end portion through the lower opening into the recess, in a securely clamped state is guided between an inner wall and a retaining region of the triggering element arranged above the pivot axis, and is clamped in a force-fitting and/or form-fitting manner, and is guided through the upper opening out of the pole grip, and wherein the clamping is released by a tilting of the triggering element about the pivot axis and the second end portion can be moved downwards in the pole grip.

2. The pole grip according to claim 1, wherein the second end portion which is guided out of the pole grip by way of the upper opening is guided back to the pole grip again to form a loop and is fixed with its free end on the pole grip.

3. The pole grip according to claim 2, wherein the recess in the wall section of the inner wall facing the retaining region comprises a receiving recess in which the free end is fastened.

4. The pole grip according to claim 3, wherein a fixing element is arranged in the receiving recess, wherein the front side thereof forms a counterpressure surface against which the retaining region directly clamps the second end portion and wherein the free end is clamped between the rear side thereof opposite the front side and a wall section of the receiving recess.

5. The pole grip according to claim 4, wherein the fixing element is inserted from above into the receiving recess, and the free end is substantially only fastened in a force-fitting and/or form-fitting manner on the pole grip by clamping between fixing element and receiving recess.

6. The pole grip according to claim 2, wherein the recess in the wall section of the inner wall facing the retaining region comprises a receiving recess in the form of a T-shaped recess with an open region facing the triggering element and two lateral extensions, in which the free end is fastened.

7. The pole grip according to claim 3, wherein a fixing element is arranged in the receiving recess, wherein the front side thereof forms a counterpressure surface against which the retaining region directly clamps the second end portion and wherein the free end is clamped between the rear side thereof opposite the front side and a wall section of the receiving recess, wherein the rear side has a toothed structure.

8. The pole grip according to claim 4, wherein the fixing element is inserted from above into the receiving recess and the free end is substantially only fastened non-positively and/or positively on the pole grip by clamping between fixing element and receiving recess.

9. The pole grip according to claim 1, wherein the triggering element is accessible at least partially via the upper opening or projects from the upper opening and wherein a pressure surface for the manipulation for tilting is formed in the accessible region or the region projecting via the upper opening.

10. The pole grip according to claim 1, wherein the second end portion is inserted through the lower opening into the recess and is clamped in the securely clamped state between a rear inner wall and the retaining region of the triggering element arranged above the pivot axis, and wherein the first end portion is fixed below this clamping region on the triggering element.

11. The pole grip according to claim 10, wherein the second end portion is inserted through the lower opening into the recess and is clamped in the securely clamped state between the rear inner wall and the retaining region of the triggering element arranged above the pivot axis, and wherein the first end portion is fixed below this clamping region on the triggering element, using a fastening screw.

12. The pole grip according to claim 1, wherein the retaining region of the triggering element has a toothed structure, wherein this toothed structure is configured as a sawtooth structure so that in the securely clamped state, withdrawal of the second section downwards from the lower opening is prevented, and so that the second section is displaceable upwards from the upper opening without manipulation of the triggering element.

13. The pole grip according to claim 1, wherein the triggering element is braced against the inner wall via the retaining region by means of an elastic restoring element.

14. The pole grip according to claim 1, wherein the head region has a forwardly directed, downwardly inclined bevel, wherein the upper opening is arranged in this bevel and wherein the triggering element is accessible at least partially via the upper opening in the area of this bevel or projects beyond this and wherein in this accessible region or the region projecting beyond this upper opening, is formed as a pressure surface for the manipulation for tilting.

15. The pole grip according to claim 1, wherein the triggering element has a forwardly and downwardly directed extension in relation to the direction of use of the pole grip, which covers the gap between triggering element and the wall delimiting the upper opening of the recess at least partially in order to prevent the penetration of dirt and/or snow and/or ice.

16. The pole grip according to claim 1, wherein on the underside it has a recess for receiving a pole tube.

17. The pole grip according to claim 1, wherein the hand loop comprises one of the following:

i.) a simple loop, and ii.) a loop which can be fastened to the hand with three separate openings of which a first opening is for a thumb, a second opening is for a finger/back of hand and a third opening is for a wrist.

18. The pole grip according to claim 1, wherein the retaining region of the triggering element has a toothed structure, wherein this toothed structure is configured as a sawtooth structure so that in the securely clamped state, withdrawal of the second section downwards from the lower opening is prevented, and so that the second section is displaceable upwards from the upper opening by manipulation of an upper overhang of the second section without manipulation of the triggering element.

19. The pole grip according to claim 1, wherein the triggering element is braced against the inner wall via the retaining region by means of an elastic restoring element namely a leaf spring or spiral spring.

20. The pole grip according to claim 1, wherein the triggering element has a forwardly and downwardly directed extension in relation to the direction of use of the pole grip, which covers the gap between triggering element and the wall delimiting the upper opening of the recess substantially completely in order to prevent the penetration of dirt and/or snow and/or ice.

21. A cross-country skiing pole, trekking pole, skiing pole or Nordic walking pole having a pole grip according to claim 1.

* * * * *